United States Patent [19]

Glock

[11] 4,161,953

[45] Jul. 24, 1979

[54] METHOD OF PUFFING TOBACCO TISSUE

[75] Inventor: Eugene Glock, Richmond, Va.

[73] Assignee: American Brands, Inc., New York, N.Y.

[21] Appl. No.: 913,246

[22] Filed: Jun. 6, 1978

Related U.S. Application Data

[63] Continuation of Ser. No. 744,042, Nov. 22, 1976, abandoned, which is a continuation of Ser. No. 628,912, Nov. 5, 1975, abandoned, which is a continuation of Ser. No. 40,726, May 27, 1970, abandoned.

[51] Int. Cl.[2] ..... A24B 3/18

[52] U.S. Cl. ..... 131/140 P

[58] Field of Search ..... 131/140–144, 131/17 R

[56] References Cited

U.S. PATENT DOCUMENTS

| | | | |
|---|---|---|---|
| 2,227,634 | 1/1941 | Dalin | 131/140 A |
| 2,596,183 | 5/1952 | Sowa | 131/140 P |
| 3,785,385 | 1/1974 | Johnson | 131/140 P |

FOREIGN PATENT DOCUMENTS

| | | | |
|---|---|---|---|
| 1815169 | 7/1969 | Fed. Rep. of Germany | 131/140 P |
| 521224 | 5/1940 | United Kingdom | 131/140 P |

*Primary Examiner*—Robert W. Michell
*Assistant Examiner*—V. Millin
*Attorney, Agent, or Firm*—Pennie & Edmonds

[57] ABSTRACT

Tobacco tissue is puffed by admixing with it hot water, preferably in the form of droplets, in amounts which are substantially completely absorbed by the tobacco in five minutes or less and thus cause puffing of the tobacco cell walls, and freeze drying the resulting tobacco to retain its puffed condition.

3 Claims, No Drawings

METHOD OF PUFFING TOBACCO TISSUE

This is a continuation, of application Ser. No. 744,042, filed Nov. 22, 1976 now abandoned which is a continuation of Ser. No. 628,912 filed Nov. 5, 1975 now abandoned which is a continuation of Ser. No. 40,726, filed May 27, 1970 now abandoned.

This invention relates to the puffing of tobacco tissue.

Tobacco stems and veins have been puffed heretofore by treating them with steam so that moisture will penetrate the fibrous structure and by then heating the moisturized stems, or exposing them to a vacuum, so as to cause the fibrous mass to explode and become puffed. The same treatment has been tried with laminar tobacco, but when the treated product is dried the expansion disappears and the dried product has substantially the same volume as before treatment.

A more effective puffing of laminar tobacco such as shreds for cigarettes has been achieved heretofore by soaking the shreds in a relatively large volume of cold water and subsequently freeze-drying the puffed tobacco. The amount of cold water required has been about 8 times the weight of tobacco treated, and soaking in this amount of water for close to one hour, or even more, has been necessary to obtain the desired puffing of the tobacco. During this soaking period a considerable amount of the water-soluble constituents of the tobacco goes into solution in the body of water while the tobacco shreds float near the top. Stirring during the soaking is not desirable because of its tendency to tangle or mat the tobacco shreds. When puffing of the tobacco has been effected in this way, the entire mass of water and tobacco has been frozen into a single block of ice in which the tobacco is concentrated at the top and the water-soluble extractives are contained in the lower main body of the block. The block has then been evaporated in a vacuum with resulting formation of a dry product consisting essentially of the puffed shreds lying on a film-like layer of water-extracted solids which must then be re-combined. The resulting product has been characterized by an objectionable amount of tackiness because of the hygroscopicity of the film-like component which forms a surface layer on the shred portion of the re-combined material. In addition, some of the natural curliness of the shreds has been lost by their becoming limp during the protracted soaking period. As a result of this loss of natural curl and the tendency of the tacky material to mat when handled, the limited puffiness of the final product has not answered the needs of the cigarette manufacturer.

I have now devised a method of puffing tobacco tissue which yields a non-tacky puffed product admirably suited for further processing into a smoking product. According to my invention, the tobacco tissue is puffed by admixing with the tobacco droplets of hot water at a temperature of at least about 70° C. and in amount such that within a maximum period of about 5 minutes substantially all of the water has been absorbed by and has effected puffing of the cell walls and associated colloids of the tobacco tissue, and freeze-drying the resulting tobacco to retain its puffed condition.

The method of the present invention is applicable to all tobacco materials, including stems and veins, but its greatest value is in puffing tobacco tissue such as the laminar or leaf portions of the plant in the form of strips (i.e. leaves with the stems removed) or shredded tobacco in the form normally used for cigarette filler.

The method of the invention uses hot water in the form of droplets. Hot water penetrates the waxy natural surface of tobacco tissue more rapidly than cold water and thus shortens the treating time over that required when using cold water, and provides greater swelling of the tobacco tissue for a given amount of water. In addition, the amount of hot water used is limited to that which, within a maximum period of about 5 minutes, and preferably within less than a minute, will be substantially completely absorbed by the tobacco. In such a treatment, the hot water penetrates the tobacco intermolecularly at the cells walls and causes these walls and associated colloids to swell. Any excess of water beyond that which causes this swelling will be held in the tissue by capillary action as long as the amount of hot water used is limited to that which will be substantially completely absorbed by the tobacco. Although the capillary water may tend to extract some water-soluble material from the tobacco, the extractives are nevertheless held within the capillaries or in interstices and do not come to the surface of the tissue to any significant extent. Thus, by eliminating the presence of any standing water in contact with the tobacco being heated, there is considerable reduction of transfer of the hygroscopic extractives to the surface of the tissue where they could cause tackiness of the tissue. At the other extreme of the amount of water used, represented by the use of steam instead of a standing body of water, the amount of moisture contained in steam is insufficient to promote significant swelling of the tobacco tissue cell walls. The amount of hot water droplets used in practicing the present invention is therefore generally restricted to about 1 to 6 parts by weight of water per part of tobacco (dry basis) in order to achieve the desired cell wall swelling, and possibly capillary water accumulation, without any significant amount of free standing water being present.

The temperature of the hot water droplets used in practicing the invention should be at least about 70° C. and preferably at least 90° C. Water at its boiling point, or at temperatures above its boiling point under pressure, can also be used. The high temperature of the treating water, and its use for only a short period of time in the form of small discrete masses of droplets, as required for effecting the desired puffing pursuant to the invention, has been found to not significantly affect the manufacturing and smoking quality of the tobacco. Maintenance of the desired treating temperature, and concomitant use of minimum treating time, can be facilitated by the presence of high temperature steam although, as explained hereinbefore, the steam contributes very little to the amount of water available for penetration and swelling of the tobacco cell walls.

The hot water droplets are applied to the tobacco pursuant to the invention in the form of a spray. The spray may be formed by atomization with the assistance of air, but in this case the air should be hot in order not to cool the water droplets. Steam can also be used to form the spray by atomization, but it is presently preferred to form the spray by simple conventional mechanical means such as a spray jet.

The water droplets can be applied to the tobacco while the latter is being carried mechanically through a spray-application zone. However, unless the tobacco is spread in a thin layer, the application of water droplets will not be uniform. The presently preferred practice is to effect contact between the tobacco and the water droplets by permitting the tobacco to fall through a zone of water droplets in order to obtain maximum uniformity of contact. The amount of water contacted with the tobacco under such conditions can be readily controlled by the concentration of the spray in the contact zone, the length of the contact zone through which the tobacco falls, and the rate at which the tobacco falls through this zone as affected, for example, by the direction of the spray and by any updraft or downdraft existing intentionally or unavoidably in the contacting vessel.

After the tobacco has been contacted with the desired amount of hot water droplets for the requisite time to effect swelling of the tobacco cell walls as aforementioned, the puffed tobacco is freeze-dried by any appropriate conventional means. For example, the puffed tobacco can be frozen by carrying it through, or by allowing it to fall through, a refrigeration zone in which freezing is effected. However, low-vacuum evaporative freezing, such as at pressures between about 5 and 0.1 mm. of mercury, can be used in either of these handling procedures. When frozen, it will be observed that there is a negligible amount of free ice on the puffed tobacco material and that any initial curliness of the tobacco, as in the case of shreds for cigarette making, has been maintained. The frozen puffed tobacco is then dried by conventional low vacuum technique, and the resulting dried product will have virtually the same degree of puffiness as that at the end of the hot water droplet absorption treatment.

The following specific example is illustrative but not limitative of the practice of the invention:

The lamina portion of the flue-cured tobacco leaves, after curing and aging, was cut at a shred width of thirty-two cuts/inch and placed into a metal tray at a depth of one-half inch. Water at a temperature of 90° was reduced to spray particles of 0.01–3.0 mm diameter by air pressure and was applied to the tobacco at a ratio of four parts of water to one part of tobacco by weight. A second layer of tobacco was added and sprayed in like manner. The water was imbibed by the tobacco with resultant swelling of the latter. Within five minutes of completion of spraying, the tray containing the wetted tobacco was placed in a vacuum chamber and evacuated to a pressure of 2.5 mm of mercury which resulted in evaporative freezing. The frozen product was freeze-dried at a pressure of 0.5 mm of mercury with the product temperature being increased by indirect heating throughout the cycle to a maximum product temperature of about 180° F. The total treating time required for wetting, freezing and drying was about nine hours. The specific volume of the tobacco was increased by a factor of 2.16 to 1 as measured after moisture equilibration in an atmosphere at 63% relative humidity and 80° F.

I claim:

1. A method for puffing tobacco tissue which consists essentially of:

(A) admixing tobacco tissue with hot water at a temperature of at least about 70° C. to the boiling point thereof, said hot water being added in an amount such that substantially all the hot water is absorbed by the tobacco tissue within a maximum period of five (5) minutes, said tobacco tissue being puffed by the absorbed hot water;

(B) evaporatively freeze-drying the puffed tobacco tissue of step (A) under subatmospheric pressure; and (C) recovering tobacco tissue having a retained puffed condition free of an objectionable amount of tackiness caused by hydroscopic extractives on the surface of the tobacco tissue.

2. The method according to claim 1 in which the temperature of the water admixed with the tobacco is at least about 90° C. and the amount of water is about 1 to 6 parts by weight for each part by weight of tobacco, dry basis.

3. The method according to claim 1 in which the hot water, in the amount of about 1 to 6 parts by weight for each part by weight of tobacco, dry basis, is admixed with and absorbed by the tobacco while the tobacco is falling freely through a mass of droplets of the hot water.

* * * * *

UNITED STATES PATENT AND TRADEMARK OFFICE

CERTIFICATE OF CORRECTION

PATENT NO. : 4,161,953

DATED : July 24, 1979

INVENTOR(S) : Eugene Glock

It is certified that error appears in the above-identified patent and that said Letters Patent are hereby corrected as shown below:

Column 3, line 35, "90°" should read --90°C--.

Column 3, line 36, "0.01" should read --0.1--.

Signed and Sealed this

*Eleventh* Day of *December 1979*

[SEAL]

*Attest:*

SIDNEY A. DIAMOND

*Attesting Officer*

*Commissioner of Patents and Trademarks*